US009995558B2

(12) United States Patent
Heo et al.

(10) Patent No.: US 9,995,558 B2
(45) Date of Patent: Jun. 12, 2018

(54) WEAPON CONTROL SYSTEM AND CONTROL METHOD THEREOF

(71) Applicant: Hanwha Techwin Co., Ltd., Changwon-si (KR)

(72) Inventors: Man Jung Heo, Changwon-si (KR); Young Jin Seo, Changwon-si (KR); Hee Hak Yun, Changwon-si (KR)

(73) Assignee: HANWHA LAND SYSTEMS CO., LTD., Changwon-si (KR)

( * ) Notice: Subject to any disclaimer, the term of this patent is extended or adjusted under 35 U.S.C. 154(b) by 0 days. days.

(21) Appl. No.: 15/438,915

(22) Filed: Feb. 22, 2017

(65) Prior Publication Data

US 2018/0080739 A1 Mar. 22, 2018

(30) Foreign Application Priority Data

Sep. 20, 2016 (KR) ..... 10-2016-0120141

(51) Int. Cl.

| | |
|---|---|
| ***F41G 5/14*** | (2006.01) |
| ***F41G 3/12*** | (2006.01) |
| ***F41G 3/22*** | (2006.01) |
| ***F41G 3/16*** | (2006.01) |
| ***F41G 3/02*** | (2006.01) |

(52) U.S. Cl.

CPC ..... *F41G 5/14* (2013.01); *F41G 3/02* (2013.01); *F41G 3/12* (2013.01); *F41G 3/16* (2013.01); *F41G 3/22* (2013.01)

(58) Field of Classification Search

CPC ..... F41G 3/02; F41G 3/10; F41G 3/12; F41G 3/16; F41G 3/22; F41G 5/02; F41G 5/04; F41G 5/06; F41G 5/14; F41G 5/20; F41G 5/22; F41G 5/24

See application file for complete search history.

(56) References Cited

U.S. PATENT DOCUMENTS 4,282,794 A * 8/1981 Miller ..... B60G 17/052 182/148

5,682,006 A 10/1997 Perry et al.

(Continued)

FOREIGN PATENT DOCUMENTS

| | | | |
|---|---|---|---|
| KR | 100576296 | B1 | 5/2006 |
| KR | 101386643 | B1 | 4/2014 |
| KR | 101569735 | B1 | 11/2015 |

*Primary Examiner* — Bret Hayes

(74) *Attorney, Agent, or Firm* — Sughrue Mion, PLLC

(57) ABSTRACT

A weapon control system includes a base, a frame rotatably coupled to the base and rotatable around a first rotation axis, a first actuator rotating the frame with respect to the base, a first weapon rotatably coupled to the frame and rotatable around a second rotation axis in a direction crossing the first rotation axis, a second actuator rotating the first weapon with respect to the frame, a rotating support rotatably coupled to the frame and rotatable around a third rotation axis in a direction crossing the first rotation axis, a third actuator rotating the rotating support with respect to the frame, a second weapon rotatably coupled to the rotating support and rotatable around a fourth rotation axis in a direction crossing the third rotation axis, a fourth actuator rotating the second weapon with respect to the rotating support, and an actuator controller controlling the first actuator, the second actuator, the third actuator, and the fourth actuator.

15 Claims, 14 Drawing Sheets

(56) References Cited

U.S. PATENT DOCUMENTS

| | | | | |
|---|---|---|---|---|
| 6,769,347 | B1 * | 8/2004 | Quinn | F41A 27/28 89/41.05 |
| 7,669,513 | B2 | 3/2010 | Niv et al. | |
| 8,245,624 | B1 | 8/2012 | Green | |
| 2001/0015126 | A1 * | 8/2001 | Grunewald | F41A 27/08 89/1.41 |
| 2004/0050240 | A1 * | 3/2004 | Greene | F41G 3/06 89/41.06 |
| 2012/0247317 | A1 | 10/2012 | Karakookly | |
| 2014/0116234 | A1 * | 5/2014 | Jacq | F41A 23/20 89/1.11 |

* cited by examiner

WEAPON CONTROL SYSTEM AND CONTROL METHOD THEREOF

CROSS-REFERENCE TO RELATED APPLICATION

This application claims priority from Korean Patent Application No. 10-2016-0120141, filed on Sep. 20, 2016, in the Korean Intellectual Property Office, the disclosure of which is incorporated herein in its entirety by reference.

BACKGROUND

1. Field

One or more exemplary embodiments relate to a weapon control system and a method of controlling the weapon control system, and more particularly, to a weapon control system, which may perform accurate shooting by independently controlling aiming directions of a plurality of weapons, and a method of controlling the weapon control system.

2. Description of the Related Art

Weapon control systems are mounted on military combat vehicles, fighter planes, and warships, and are used for attack and defense against an enemy. The weapon control system is mainly used for surveillance of the surrounding area in peace and is operated to attack the enemy by using weapons during warfare.

When a combat mission is carried out at a position close to or far away from a target, the weapon control system may enable accurate shooting to the target by remotely controlling weapons without exposing a shooter, thereby effectively completing the combat mission without damage to the shooter.

A weapon control system capable of independently controlling two weapons mounted on a vehicle and performing shooting may be used to secure superiority of firepower.

Korean Patent No. 1569735 discloses a weapon control system in which a mortar launch tube and a machine gun are placed on a rotatable plate. The weapon control system has a limitation in which two weapons having different trajectories may not be used at the same time. In other words, when a rotation angle of the rotatable plate is set to have the machine gun shoot a target, it is not possible to use the mortar to shoot the target. Accordingly, the operation of the mortar is paused until the machine gun stops shooting.

U.S. Pat. No. 8,245,624 discloses a weapon control system in which two weapons are mounted and rotated by one rotation shaft. In the weapon control system, a rotation direction of a first weapon and a rotation direction of a second weapon are separately controlled to allow the first weapon and the second weapon to aim at targets, and thus, the first weapon and the second weapon may perform shooting at the same time.

However, in such a weapon control system, since the first weapon and the second weapon are placed on the same plate mounted on a vehicle, the shooting ranges of the first weapon and the second weapon overlap each other. In other words, when the first weapon and the second weapon are simultaneously aimed at the same target, a shooting range (trajectory range) of the first weapon and a shooting range of the second weapon overlap each other. Furthermore, since a horizontal shooting range of the first weapon overlaps an installation position of the second weapon or a horizontal shooting range of the second weapon overlaps an installation position of the first weapon, shooting operations of the first weapon and the second weapon are limited.

SUMMARY

One or more exemplary embodiments of the present disclosure include a weapon control system, which may perform accurate shooting by independently controlling aiming directions of a plurality of weapons, and a method of controlling the weapon control system.

One or more exemplary embodiments include a weapon control system, which may simultaneously shoot a plurality of targets or concentrate firepower on a single target by using a plurality of weapons having different trajectories at the same time, and a method of controlling the weapon control system.

One or more exemplary embodiments include a weapon control system, which may perform efficient shooting by reducing mechanical interference and a trajectory range (shooting range) interference of a plurality of weapons, and a method of controlling the weapon control system.

Additional aspects will be set forth in part in the description which follows and, in part, will be apparent from the description, or may be learned by practice of the exemplary embodiments presented herein.

According to one or more exemplary embodiments, a weapon control system includes a base, a frame rotatably coupled to the base and rotatable around a first rotation axis, a first actuator rotating the frame with respect to the base, a first weapon rotatably coupled to the frame and rotatable around a second rotation axis in a direction crossing the first rotation axis, a second actuator rotating the first weapon with respect to the frame, a rotating support rotatably coupled to the frame and rotatable around a third rotation axis in a direction crossing the first rotation axis, a third actuator rotating the rotating support with respect to the frame, a second weapon rotatably coupled to the rotating support and rotatable around a fourth rotation axis in a direction crossing the third rotation axis, a fourth actuator rotating the second weapon with respect to the rotating support, and an actuator controller controlling the first actuator, the second actuator, the third actuator, and the fourth actuator.

The second rotation axis and the third rotation axis may be parallel with each other.

The third rotation axis may be spaced apart from the second rotation axis in an upward direction away from the base.

The first rotation axis and the fourth rotation axis may be spaced apart from each other in parallel with each other.

The first rotation axis and the fourth rotation axis may match each other.

The weapon control system may further include an imaging apparatus rotatably coupled to the frame and rotatable around a fifth rotation axis in a direction crossing the first rotation axis, and a fifth actuator rotating the imaging apparatus with respect to the frame.

The fifth rotation axis may be spaced apart from the second rotation axis in a downward direction toward the base.

The weapon control system may further include a firing controller that controls firing of the first weapon and firing of the second weapon.

The weapon control system may further include an operating computer electrically connected to the actuator controller and the firing controller and providing an angle adjustment signal to adjust a panning angle and a tilt angle of each of the first weapon and the second weapon and a firing control signal for firing of each of the first weapon and the second weapon.

The operating computer may receive target information relative to a target from at least one of a detection apparatus detecting the target, a tactical network, an artificial satellite, a radar, and an imaging apparatus of the weapon control system, and generating the angle adjustment signal and the firing control signal based on the target information.

The operating computer may perform one of a single shooting mode in which shooting is performed by selecting one of the first weapon and the second weapon as a firing weapon and an intense shooting mode in which shooting is performed by selecting both of the first weapon and the second weapon as firing weapons, and in the single shooting mode, after a trajectory direction of the firing weapon is corrected to be aligned to the target, a direction of the other one of the first weapon and the second weapon, not selected as the firing weapon, is adjusted to reduce mechanical interference in a shooting range of the firing weapon.

In the intense shooting mode, trajectory directions of the first weapon and the second weapon may be all corrected to be aligned to the target, and during shooting, shooting time points of the first weapon and the second weapon may be adjusted to be in sequence so that influence of vibrations due to shooting of the first weapon and the second weapon is reduced.

The weapon control system may further include a display connected to the operating computer and displaying an image, wherein the target information of the operating computer comprises information about a plurality of targets, and the operating computer assigns one of the first weapon and the second weapon to a first target, assigns order of priority to the plurality of targets, except for the first target, and displays the plurality of targets and information about the order of priority.

The weapon control system may further include a user input device that receives a user input and transfers a signal to the operating computer, wherein, when one of the plurality of targets, except for the first target, is selected as a second target through the user input device, the operating computer assigns the other one of the first weapon and the second weapon not assigned to the first target, to the second target, and adjusts trajectory directions of the first weapon and the second weapon.

When no signal to select one of the plurality of targets is input through the user input device, the operating computer may select one target of the plurality of targets having a top priority order, except for the first target, as the second target, assign the other one of the first weapon and the second weapon not assigned to the first target, to the second target, and adjust trajectory directions of the first weapon and the second weapon.

According to one or more embodiments, there is a method of controlling a weapon control system having a first weapon and a second weapon mounted on a frame, the frame being rotatable around a first rotation axis, the first weapon being rotatable around a second rotation axis in a direction crossing the first rotation axis, and the second weapon being rotatable around a third rotation axis in a direction crossing the first rotation axis and being rotatable around a fourth rotation axis in a direction crossing the third rotation axis, the method including aiming at a target by rotating the frame in a direction toward the target, selecting at least one of the first weapon and the second weapon as a firing weapon to shoot the target, correcting a trajectory of the firing weapon by adjusting at least one of a panning angle and a tilt angle of the firing weapon, and performing firing at the target by operating the firing weapon.

When only one of the first weapon and the second weapon is selected as the firing weapon in the selecting at least one of the first weapon and the second weapon as a firing weapon, the method may further include adjusting a direction of the other one of the first weapon and the second weapon not selected as the firing weapon, prior to the performing of firing, so that interference in a shooting range of the firing weapon is reduced.

In the aiming at the target, a first target may be aimed at among a plurality of targets. The method may further include receiving target information about positions of the plurality of targets, and assigning order of priorities to the plurality of targets based on the target information about positions of the plurality of targets.

The method may further include determining whether the plurality of targets are located within a range in which simultaneous firing at the plurality of targets by using the first weapon and the second weapon is possible.

The assigning of the order of priorities to the plurality of targets may include arranging the plurality of targets in an order of a distance, assigning weights to the plurality of targets, and generating and transferring information about the order of priorities of the plurality of targets. The method may further include displaying on a display the information about the order of priorities of the plurality of targets, and selecting a second target subject to firing along with the first target among the plurality of targets, wherein the selecting at least one of the first weapon and the second weapon as a firing weapon may include selecting one of the first weapon and the second weapon as a first firing weapon for firing at the first target, and selecting the other one of the first weapon and the second weapon as a second firing weapon for firing at the second target.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1A:
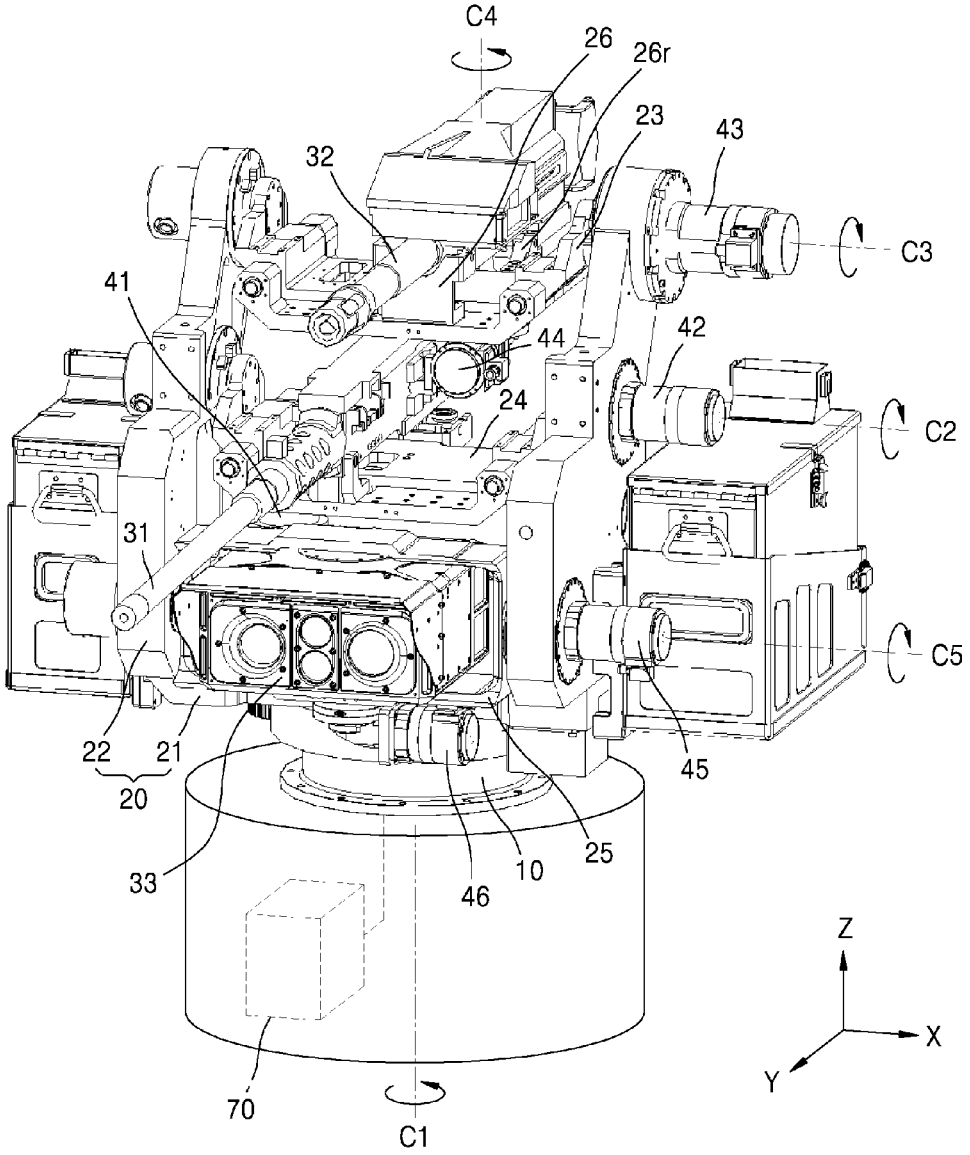
FIG. 1A is a perspective view of a weapon control system, according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present disclosure. Expressions such as "at least one of," when preceding a list of elements, modify the entire list of elements and do not modify the individual elements of the list.

Hereinafter, the structure and operation of a weapon control system according to exemplary embodiments are described in detail with reference to the accompanying drawings.

Figure 1B:
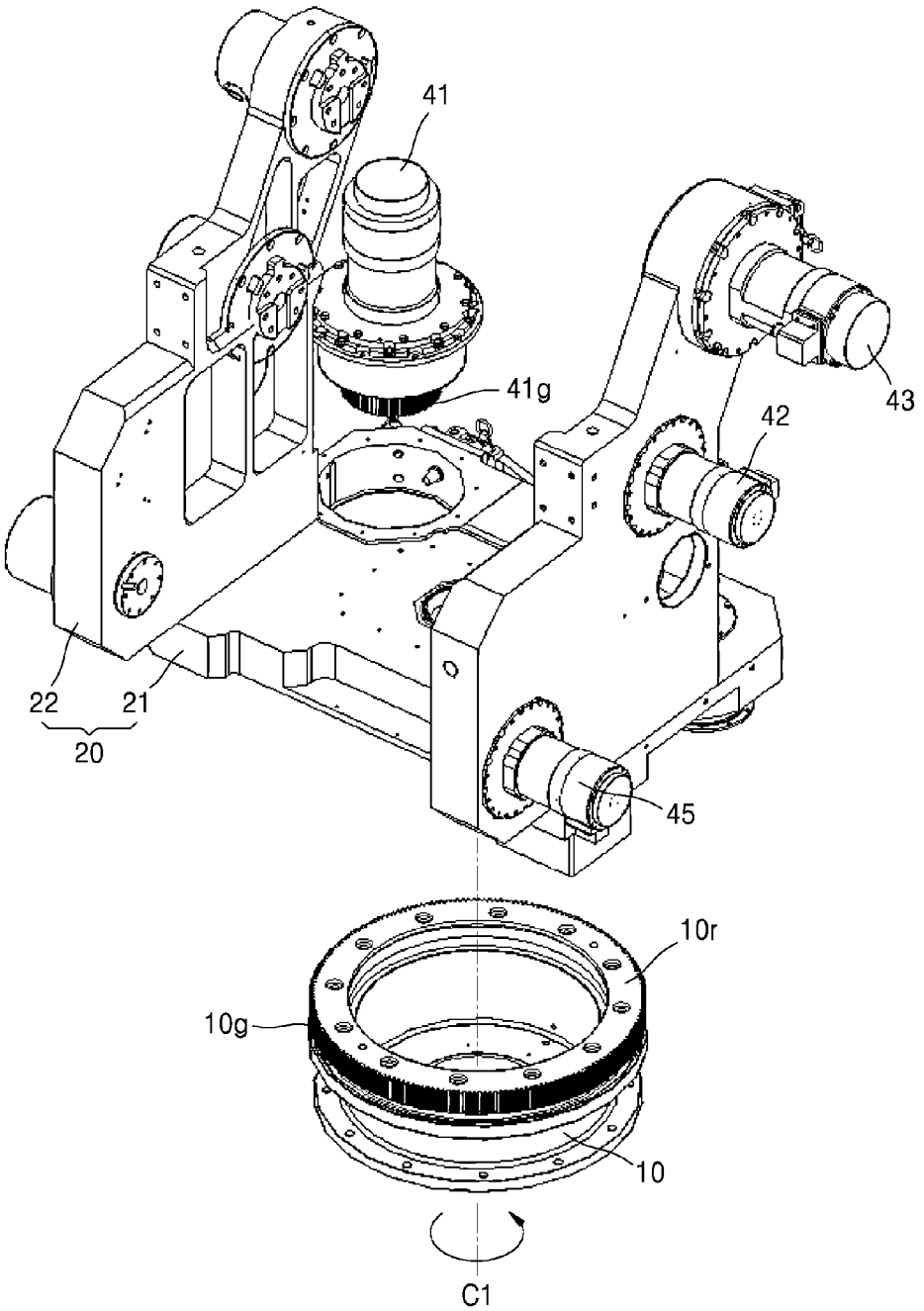
FIG. 1B is a perspective view of the weapon control system of FIG. 1, in which a base and a frame are separated from each other, according to an exemplary embodiment.
Figure 1C:
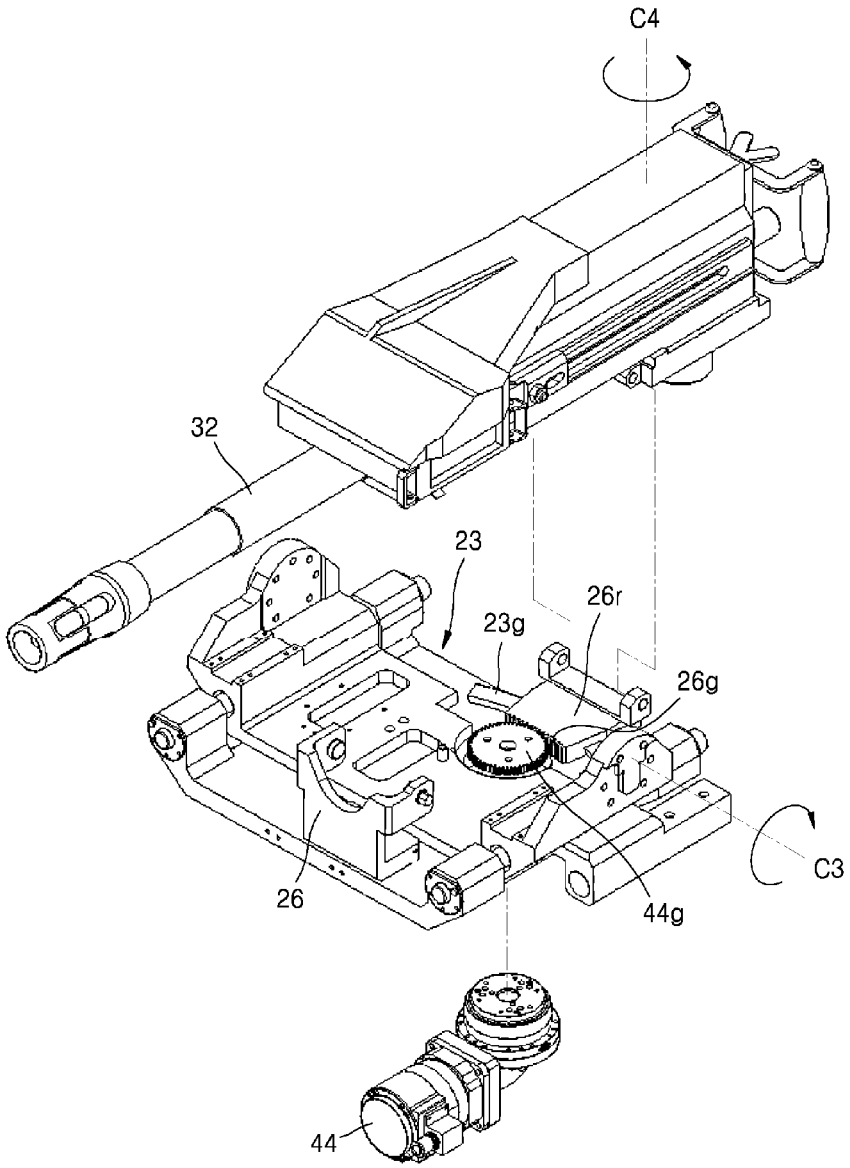
FIG. 1C is a perspective view of the weapon control system of FIG. 1, in which a second weapon and a rotatable support are separated from each other, according to an exemplary embodiment.
Figure 2:
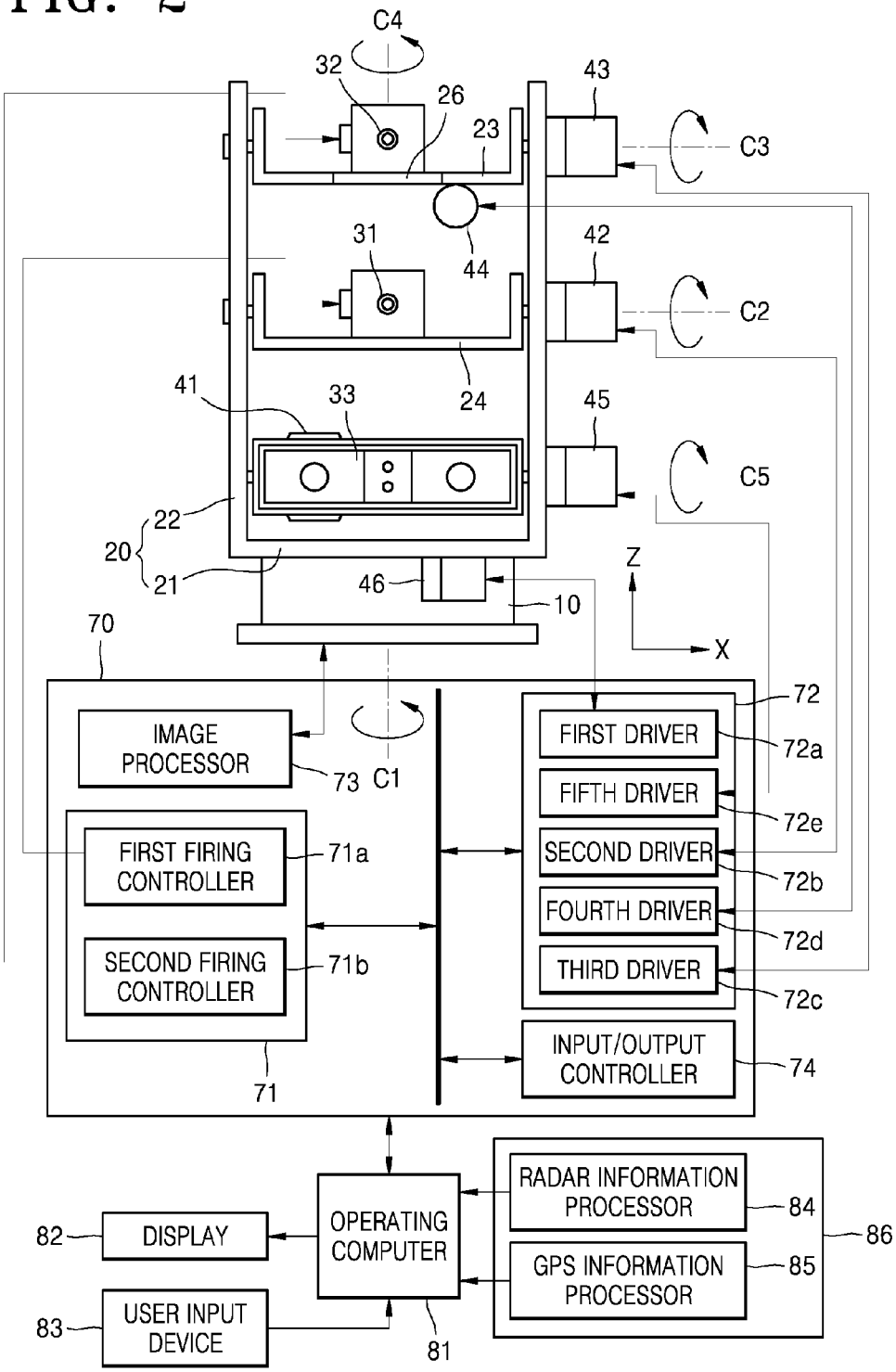
FIG. 2 is a block diagram of the weapon control system of FIG. 1, schematically showing a connection relationship between constituent elements, according to an exemplary embodiment.

FIG. 1A is a perspective view of a weapon control system according to an embodiment. FIG. 1B is a perspective view of the weapon control system of FIG. 1, in which a base and a frame are separated from each other. FIG. 1C is a perspective view of the weapon control system of FIG. 1, in which a second weapon and a rotatable support are separated from each other. FIG. 2 is a block diagram of the weapon control system of FIG. 1, schematically showing a connection relationship between constituent elements;

Referring to FIGS. 1A, 1B, 1C, and 2, the weapon control system according to the present embodiment may include a base 10, a frame 20 rotatably coupled to the base 10, a first weapon 31 and a rotating support 23 rotatably coupled to the frame 20, a second weapon 32 rotatably coupled to the rotating support 23, and a controller 70.

The base 10 may be mounted on a vehicle so that the weapon control system may be moved by the vehicle, or may be fixedly placed at a particular position. The base 10 functions as a platform supporting various constituent elements such as the first weapon 31, the second weapon 32, and an imaging apparatus 33.

The frame 20 is rotatably coupled to an upper portion of the base 10. The frame 20 may include a lower frame 21 rotatably coupled to the base 10 and rotatable around a first rotation axis C1, and a side frame 22 upwardly extending from opposite end portions of the lower frame 21.

Referring to FIG. 1B, the lower frame 21 is rotatably coupled to the base 10 and is rotatable around the first rotation axis C1 by means of a ring gear 10*r* having a gear surface 10*g* on an outer circumferential surface thereof.

A first actuator 41 is coupled to the base 10 and rotates the frame 20 around the first rotation axis C1 with respect to the base 10. The first rotation axis C1 is a rotation center of the frame 20 and corresponds to a direction parallel with a Z-axis in a vertical direction in FIG. 1. As the frame 20 rotates around the first rotation axis C1, angles in a horizontal direction of the first weapon 31 and the second weapon 32 when the first weapon 31 and the second weapon 32 aim at targets may be adjusted.

The first actuator 41 may be implemented by, for example, an electric motor operated by an electrical signal, a hydraulic motor or hydraulic cylinder operated by oil pressure, or a pneumatic cylinder operated by air pressure.

When the first actuator 41 is implemented by an electric motor, an output shaft of the first actuator 41 is connected to the frame 20 via a decelerator and a power transfer device. In FIG. 1B, the power transfer device that transfers power of the first actuator 41 to the frame 20 is implemented by a gear 41*g*. The power transfer device may be implemented by, for example, a chain or a sprocket. Since the power of the first actuator 41 is transferred to the ring gear 10*r* via the gear 41*g*, as the first actuator 41 operates, the frame 20 may rotate with respect to the base 10.

Referring to FIG. 1A, the first weapon 31, the second weapon 32, the imaging apparatus 33, a second actuator 42, a third actuator 43, and a fifth actuator 45 are coupled to the side frame 22 of the frame 20.

A middle support 24 that supports the first weapon 31 is rotatably coupled to the side frame 22 and is rotatable around a second rotation axis C2 perpendicularly crossing the first rotation axis C1. Since the first weapon 31 is fixed to the middle support 24 by a coupling device such as a bolt or a bracket, the first weapon 31 may rotate with the middle support 24 around the second rotation axis C2. The second rotation axis C2 may be in a direction perpendicularly crossing the first rotation axis C1 and may be parallel with a horizontal X-axis direction in FIG. 1.

Although in FIG. 1 the first weapon 31 is rotatably coupled to the side frame 22 via the middle support 24, the present disclosure is not limited thereto and the first weapon 31 may be rotatably coupled directly to the side frame 22. For example, the first weapon 31 may have a rod protruding in a lateral direction and the rod may be rotatably coupled to the side frame 22.

The second actuator 42 that rotates the first weapon 31 and the middle support 24 is coupled to the side frame 22. Since an output shaft of the second actuator 42 is coupled to an end portion of the middle support 24 by penetrating through the side frame 22, when the output shaft of the second actuator 42 rotates, the middle support 24 may be rotated around the second rotation axis C2.

As the first weapon 31 rotates around the second rotation axis C2, angles in a vertical direction of the first weapon 31 may be adjusted when the first weapon 31 aims at a target.

The second weapon 32 is coupled to the frame 20 and is rotatable around a third rotation axis C3 that is in a direction crossing the first rotation axis C1. Referring to FIG. 1C, the second weapon 32 is coupled to the rotating support 23, and the rotating support 23 is rotatably coupled to the side frame 22 and is rotatable around the third rotation axis C3 which is in a direction crossing the first rotation axis C1. Accordingly, when the rotating support 23 rotates, the second weapon 32 may rotate with the rotating support 23 around the third rotation axis C3.

The third rotation axis C3 may be in a direction perpendicularly crossing the first rotation axis C1, and since the third rotation axis C3 is parallel with the horizontal X-axis direction of FIG. 1, the third rotation axis C3 may be parallel with the second rotation axis C2. The third rotation axis C3 is spaced apart from the second rotation axis C2 in an upward direction away from the base 10.

As such, as the second rotation axis C2 and the third rotation axis C3 are spaced apart from each other in an upward direction from the base 10, a space for adjustment of the angle in the vertical direction of the first weapon 31 and the second weapon 32 with respect to the frame 20 may be secured.

The third actuator 43 that rotates the second weapon 32 and the rotating support 23 is coupled to the side frame 22. Since an output shaft of the third actuator 43 is coupled to an end portion of the rotating support 23 by penetrating through the side frame 22, when the output shaft of the third actuator 43 rotates, the rotating support 23 and the second weapon 32 may rotate around the third rotation axis C3.

Referring to FIG. 1C, the second weapon 32 is rotatably coupled to the rotating support 23 and rotatable around a fourth rotation axis C4 which is in a direction crossing the third rotation axis C3. A rear end portion of the second weapon 32 is fixed on a rotating bracket 26*r* by using a coupling device such as a bolt or a bracket. A front end portion of the second weapon 32 is supported by a support bracket 26 fixed on the rotating support 23. The front end portion of the second weapon 32 is not fixed on the support bracket 26. While the rear end portion of the second weapon 32 rotates with the rotating bracket 26*r*, the second weapon 32 maintains a state in which a lower surface of the front end portion of the second weapon 32 is in contact with the support bracket 26 so that an angle of the front end portion of the second weapon 32 may be adjusted within a preset range.

The rotating bracket 26*r* is rotatably coupled to a rotating guide 23*g* of the rotating support 23 and is rotatable around the fourth rotation axis C4 with respect to the rotating support 23. The rotating guide 23*g* is formed on the rotating support 23, extending in an arc shape around the fourth rotation axis C4, and has a function of supporting the rotating bracket 26*r* that is rotatable around the fourth rotation axis C4. Accordingly, when the rotating bracket 26*r* rotates with respect to the rotating support 23, the second weapon 32 performs a rotation motion with the rotating bracket 26*r* around the fourth rotation axis C4 with respect to the rotating support 23.

A fourth actuator 44 is coupled to the rotating support 23 and rotates the rotating bracket 26*r* around the fourth rotation axis C4 with respect to the rotating support 23. The fourth rotation axis C4, which is a rotation center of the rotating bracket 26*r* and the second weapon 32, is parallel with a Z-axis that is the vertical direction in FIG. 1 and to the first rotation axis C1. The fourth rotation axis C4 is spaced apart from the first rotation axis C1 in a backward direction.

The fourth actuator 44 may be implemented by, for example, an electric motor operated by an electrical signal, a hydraulic motor or hydraulic cylinder operated by oil pressure, or a pneumatic cylinder operated by air pressure.

When the fourth actuator 44 is implemented by an electric motor, an output shaft of the fourth actuator 44 is connected to the rotating bracket 26*r* via a decelerator and a power transfer device. In FIG. 1C, the power transfer device that transfers power of the fourth actuator 44 to the rotating bracket 26*r* is implemented by a gear 44*g*. Alternatively, the power transfer device may be implemented by, for example, a chain or a sprocket.

Since the power of the fourth actuator 44 is transferred to a gear 26*g* of the rotating bracket 26*r* via the gear 44*g*, as the fourth actuator 44 operates, the rotating bracket 26*r* and the second weapon 32 perform a rotation motion with respect to the rotating support 23.

The imaging apparatus 33 is rotatably coupled to the side frame 22 at a position under the first weapon 31 with respect to the side frame 22. The imaging apparatus 33 is supported by the imaging apparatus support 25, and the imaging apparatus support 25 is rotatably coupled to the side frame 22. Accordingly, the imaging apparatus 33 and the imaging apparatus support 25 may rotate around a fifth rotation axis C5 which is in a direction crossing the first rotation axis C1.

The fifth actuator 45 is coupled to the side frame 22 and rotates the imaging apparatus 33. The fifth rotation axis C5 may be in a direction perpendicularly crossing the first rotation axis C1 and parallel with the second rotation axis C2 and the third rotation axis C3. Furthermore, the fifth rotation axis C5 is spaced apart from the second rotation axis C2 in a downward direction toward the base 10.

Furthermore, the imaging apparatus 33 is rotatable in the horizontal direction with respect to an axis parallel with the first rotation axis C1 with respect to the imaging apparatus support 25. A sixth actuator 46 that rotates the imaging apparatus 33 in the horizontal direction is coupled to the imaging apparatus support 25.

Referring to FIG. 2, the controller 70 is electrically connected to and controls the first actuator 41, the second actuator 42, the third actuator 43, and the fourth actuator 44.

The controller 70 may include a firing controller 71 connected to each of the first weapon 31 and the second weapon 32 and controlling firing of the first weapon 31 and the second weapon 32; an actuator controller 72 controlling each of the actuators 41, 42, 43, and 44; an image processor 73 connected to and controlling the imaging apparatus 33, and processing an image; and an input/output controller 74 controlling input and output signals. The firing controller 71 may include a first firing controller 71*a* controlling firing of the first weapon 31, and a second firing controller 71*b* controlling firing of the second weapon 32.

The controller 70 may be implemented by a control computer installed in a weapon control system or a vehicle mounted with the weapon control system, a circuit board included in a computer, a semiconductor chip mounted on a circuit board, or control software included in a semiconductor chip or a computer.

The actuator controller 72 may include a first driver 72*a*, a second driver 72*b*, a third driver 72*c*, a fourth driver 72*d*, and a fifth driver 72*e* for respectively controlling the first actuator 41, the second actuator 42, the third actuator 43, the fourth actuator 44, and the fifth actuator 45. Each of the actuators may be equipped with an encoder for detecting the position of a drive shaft, and a signal of each encoder may be transferred to each of the drivers connected to each actuator.

The weapon control system may include an operating computer 81 that is electrically connected to the firing controller 71 and the actuator controller 72 of the controller 70. The operating computer 81 may supply an angle adjustment signal to adjust a panning angle (azimuth angle) and tilt angle (elevation angle) of each of the first weapon 31 and the second weapon 32, and a firing control signal to control firing of each of the first weapon 31 and the second weapon 32.

The operating computer 81 is mounted on the base 10 of the weapon control system or on a vehicle mounted with the weapon control system, and is connected to the controller 70 by a wired communication method. Alternatively, the operating computer 81 is mounted at a position far from the vehicle and the base 10 of the weapon control system and remotely controls the angle adjustment operation and firing of the first weapon 31 and the second weapon 32, and the photographing operation of the imaging apparatus 33 in the weapon control system.

The weapon control system may include a display 82 electrically connected to the operating computer 81 and displaying an image. The display 82 may display information about a target to be hit by the weapon control system, that is, information about a position or distance of a target, or information about the order of priority for firing at targets during firing. Furthermore, the display 82 may display information about a panning angle and a tilt angle of the first weapon 31 and the second weapon 32.

Furthermore, the display 82 may be implemented by a touch screen so that a user may select or input a menu or information by touching a surface thereof. A user of the weapon control system may check the information displayed on the display 82 and select targets displayed on the display 82.

The weapon control system may include a user input device 83 that is electrically connected to the operating computer 81, and may receive a user's input operation and transfer a signal of the user's input operation to the operating computer 81. The user input device 83 may be a joystick, a mouse, a keyboard, or a combination thereof.

The operating computer 81 may be connected to an information network 86 that includes a radar information processor 84 and a global positioning system (GPS) information processor 85. The radar information processor 84 receives information from a radar device and transfers the information to the operating computer 81. The GPS information processor 85 receives geographical position information from GPS satellites and transfers the geographical position information to the operating computer 81.

Figure 3:
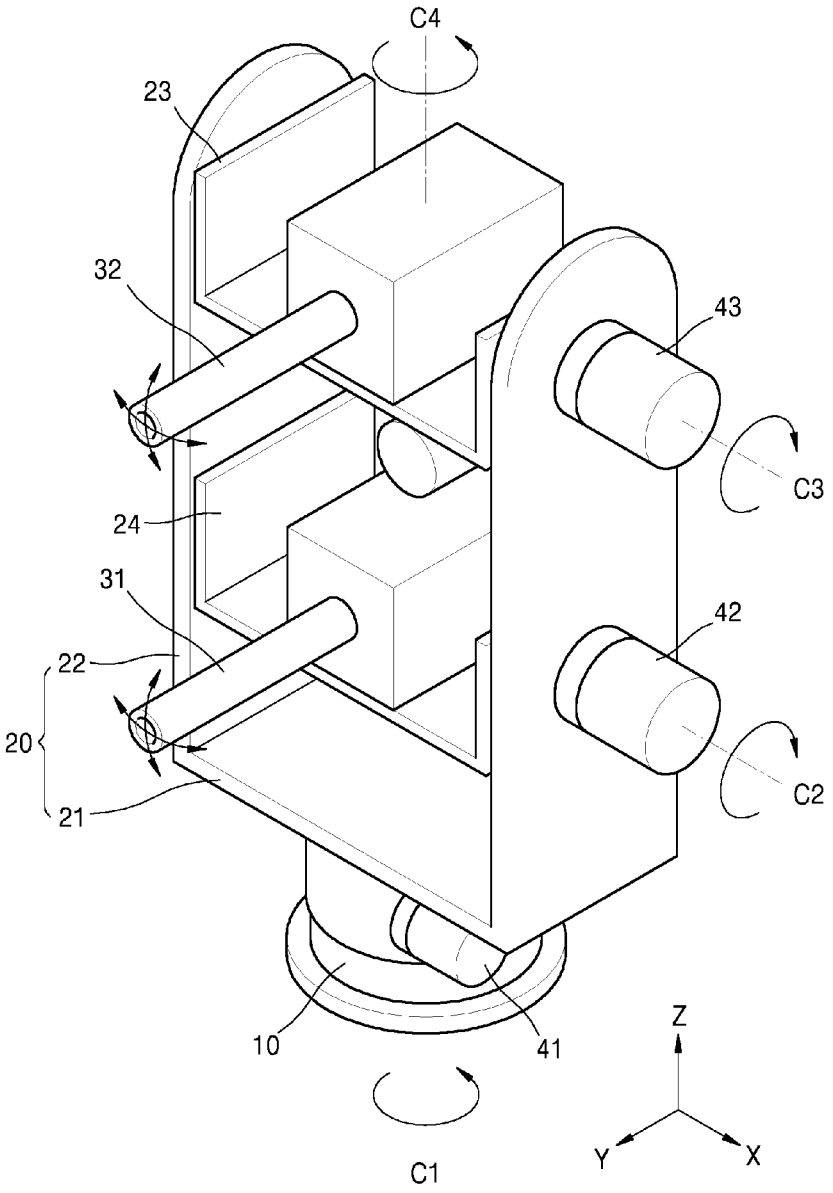
FIG. 3 is a perspective view of a weapon control system, according to an exemplary embodiment.

FIG. 3 is a perspective view of a weapon control system according to a second embodiment.

Referring to FIG. 3, the weapon control system according to the second embodiment may include the base 10; the frame 20 having the side frame 22 and the lower frame 21, and which is coupled to the base 10 and rotatable around the first rotation axis C1; the first weapon 31 rotatably coupled to the frame 20 with respect to the second rotation axis C2; the rotating support 23 rotatably coupled to the frame 20 and rotatable around the third rotation axis C3; and the second weapon 32 rotatably coupled to the rotating support 23 and rotatable around the fourth rotation axis C4. In FIG. 3, illustration of the constituent elements such as the controller or the imaging apparatus 33 as illustrated in FIGS. 1 and 2 is omitted.

In the weapon control system according to the embodiment illustrated in FIG. 3, the first weapon 31 and the second weapon 32 are identical to each other. In other words, although in the weapon control system according to FIGS. 1 and 2, the trajectory ranges of the first weapon 31 and the second weapon 32 are different from each other, the trajectory ranges of the first weapon 31 and the second weapon 32 of FIG. 3 are identical to each other.

Furthermore, although in the weapon control system of FIG. 1, the first rotation axis C1 and the fourth rotation axis C4 are arranged in parallel, but spaced apart from each other, in the weapon control system of FIG. 3, the first rotation axis C1 and the fourth rotation axis C4 are arranged to coincide.

Figure 4:
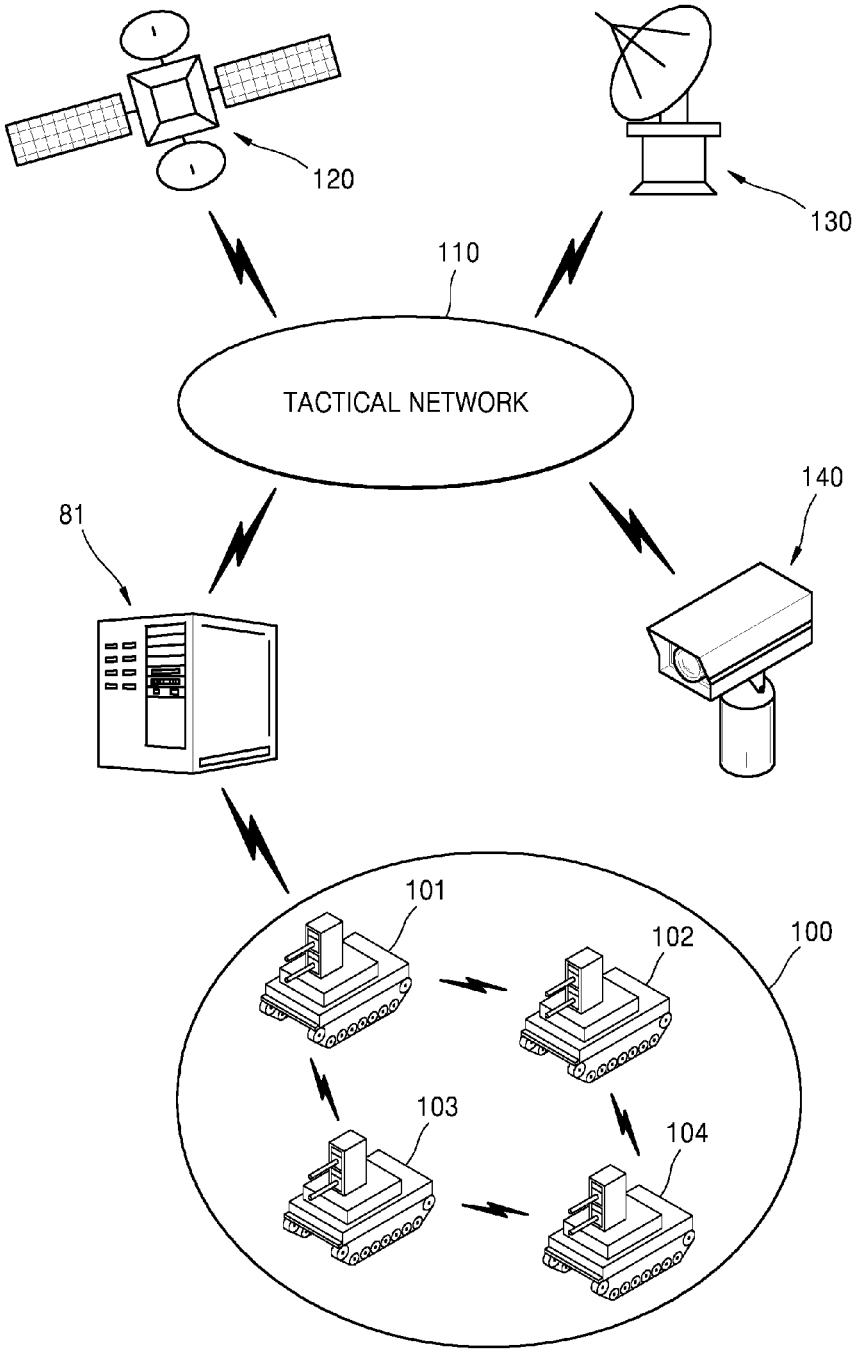
FIG. 4 is a conceptual view of an exemplary operation of the weapon control system of FIGS. 1 and 2, according to an exemplary embodiment.

FIG. 4 is a conceptual view of an exemplary operation of the weapon control system of FIGS. 1 and 2.

Referring to FIG. 4, a tactical group 100 includes combat vehicles 101, 102, 103, and 104, each combat vehicle being mounted with the base 10, the frame 20, the first weapon 31, and the second weapon 32 of the weapon control systems as illustrated in any of FIGS. 1 to 3. Each of the combat vehicles 101, 102, 103, and 104 may be connected to the operating computer 81, located outside the combat vehicles 101, 102, 103, and 104, to be capable of communicating with each other by a wireless communication method. The combat vehicles 101, 102, 103, and 104 may be connected to each other by a wireless communication method.

The operating computer 81 is connected to a tactical network 110, a detection apparatus 140 detecting a target, an artificial satellite 120 providing GPS information, a radar 130, and the imaging apparatus 33 of the weapon control system mounted on the combat vehicles 101, 102, 103, and 104, so as to be capable of communicating with one another by a tactical data link system.

The operating computer 81 may receive target information related to a target from at least one of the detection apparatus 140, the tactical network 110, the artificial satellite 120, the radar 130, and the imaging apparatus 33 of the weapon control system. The target information that the operating computer 81 receives may include locational information about the positions of a plurality of targets, locational information of the combat vehicles 101, 102, 103, and 104, distance information, climate information, and information related to tactics to hit targets.

The operating computer 81 may generate an angle adjustment signal to adjust angles of weapons of the combat vehicles 101, 102, 103, and 104 and a firing control signal to instruct firing of weapons, based on the target information, and transfer the signals to the combat vehicles 101, 102, 103, and 104.

The operating computer 81 may select and perform any one of a single shooting mode and an intense shooting mode to perform firing by using the weapon control systems of the combat vehicles 101, 102, 103, and 104.

The single shooting mode is a mode of performing shooting by selecting, as a firing weapon, any one of the first weapon and the second weapon of the weapon control system mounted on each of the combat vehicles 101, 102, 103, and 104. The "firing weapon" is a term referring to a weapon selected to perform firing at the target. For example, when the first weapon is selected as a firing weapon in the single shooting mode, the second weapon may be controlled to halt shooting while the first weapon performs a firing motion.

The intense shooting mode is a mode of performing shooting by selecting, as firing weapons, both of the first weapon and the second weapon of the weapon control system mounted on each of the combat vehicles 101, 102, 103, and 104.

Figure 5:
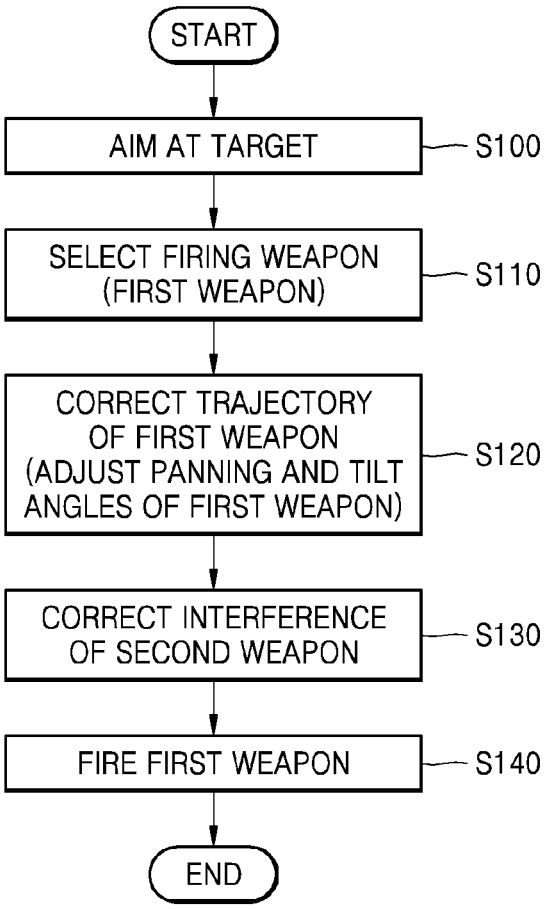
FIG. 5 is a flowchart of a method of controlling the weapon control system of FIGS. 1 and 2, according to an exemplary embodiment.

FIG. 5 is a flowchart of a method of controlling the weapon control system of FIGS. 1 and 2, according to an embodiment. In FIG. 5, the operations of the single shooting mode performed by selecting the first weapon of the weapon control system as a firing weapon are explained.

In the single shooting mode in which the first weapon is selected as a firing weapon, after a mark (target) is aimed at by rotating the frame of the weapon control system (S100), the first weapon is selected as a firing weapon (S110). Then, a trajectory of the first weapon selected as the firing weapon is corrected by adjusting at least one of a panning angle and a tilt angle of the first weapon (S120). In the correcting of the trajectory of the first weapon (S120), the trajectory of the first weapon is corrected to increase accuracy of firing in consideration of the position of a target and a trajectory range of the first weapon.

Simultaneously with or after the correcting of the trajectory of the first weapon (S120), interference of the second weapon is corrected (S130). After the correcting of the interference of the second weapon, firing of the first weapon is performed (S140).

Figure 6:
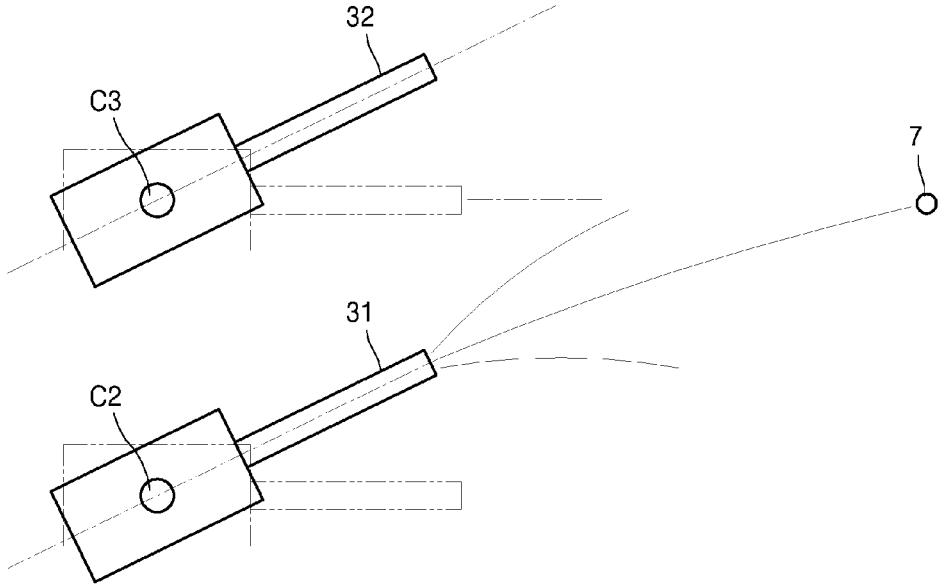
FIG. 6 is a conceptual view exemplarily illustrating angles of weapons in the operating state illustrated in FIG. 5, according to an exemplary embodiment.

FIG. 6 is a conceptual view exemplarily illustrating angles of weapons in the operating state illustrated in FIG. 5.

As illustrated in FIG. 6, in the single shooting mode in which the first weapon 31 is selected as a firing weapon, as the first weapon 31 rotates around the second rotation axis C2, a trajectory direction, that is, a tilt angle, of the first weapon 31 is adjusted to be accurately aligned to a target 7. In this state, in order to prevent mechanical interference of the second weapon 32 with the shooting range of the first weapon 31 that is the firing weapon, the second weapon 32 rotates around the third rotation axis C3 so that a fixed direction angle of the second weapon 32 is adjusted to be parallel with a pitch direction of the first weapon 31. The shooting range of the first weapon 31 includes a range in the horizontal direction and a range in the vertical direction, in which a projectile fired by the first weapon 31 may travel when the first weapon 31 is operated to perform shooting.

Figure 7:
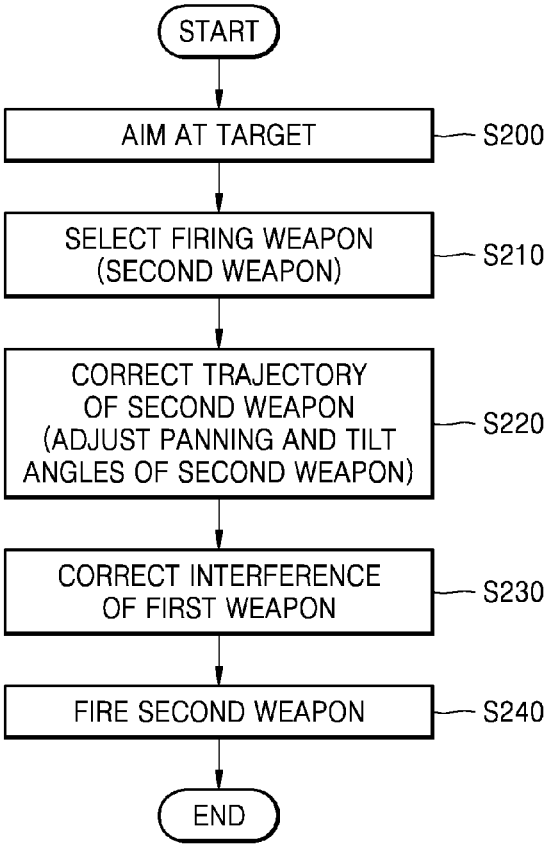
FIG. 7 is a flowchart of a method of controlling the weapon control system of FIGS. 1 and 2, according to an exemplary embodiment.

FIG. 7 is a flowchart of a method of controlling the weapon control system of FIGS. 1 and 2, according to another embodiment. In FIG. 7, the operations of the single shooting mode performed by selecting the second weapon of the weapon control system as a firing weapon are described.

In the single shooting mode in which the second weapon is selected as a firing weapon, after a mark (target) is aimed at by rotating the frame of the weapon control system (S200), the second weapon is selected as the firing weapon (S210). Then, a trajectory of the second weapon selected as the firing weapon is corrected by adjusting at least one of a panning angle and a tilt angle of the second weapon (S220). In the correcting of the trajectory of the second weapon (S220), the trajectory of the second weapon is corrected to increase accuracy of firing in consideration of the position of a target and a trajectory range of the second weapon.

Simultaneously with or after the correcting of the trajectory of the second weapon (S220), interference by the first weapon is corrected (S230). After the correcting of the interference by the first weapon, firing of the second weapon is performed (S240).

Figure 8:
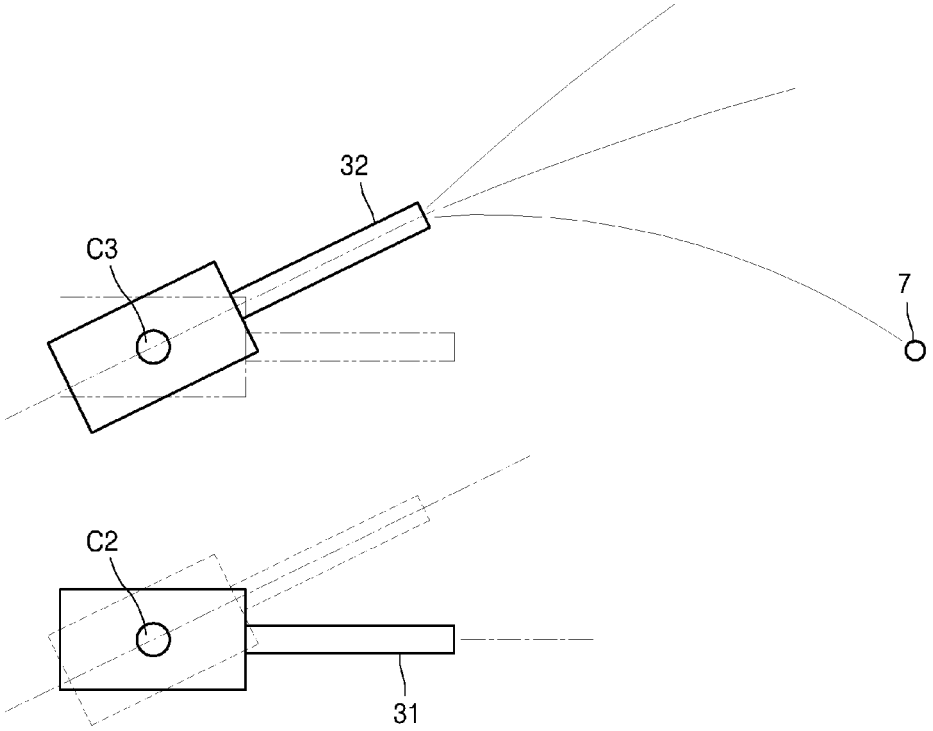
FIG. 8 is a conceptual view exemplarily illustrating angles of weapons in the operating state illustrated in FIG. 5, according to an exemplary embodiment.

FIG. 8 is a conceptual view exemplarily illustrating angles of weapons in the operating state illustrated in FIG. 5.

As illustrated in FIG. 8, in the single shooting mode in which the second weapon 32 is selected as a firing weapon, as the second weapon 32 rotates around the third rotation axis C3, a trajectory direction, that is, a tilt angle, of the second weapon 32 is adjusted to be accurately aligned to the target 7. In this state, in order to prevent mechanical interference of the first weapon 31 with the shooting range of the second weapon 32 that is the firing weapon, the first weapon 31 rotates around the second rotation axis C2 so that a fixed direction angle of the first weapon 31 is adjusted. The first weapon 31 may be adjusted to be parallel with the direction of the second weapon 32 or to move away from the direction of the second weapon 32.

Figure 9:
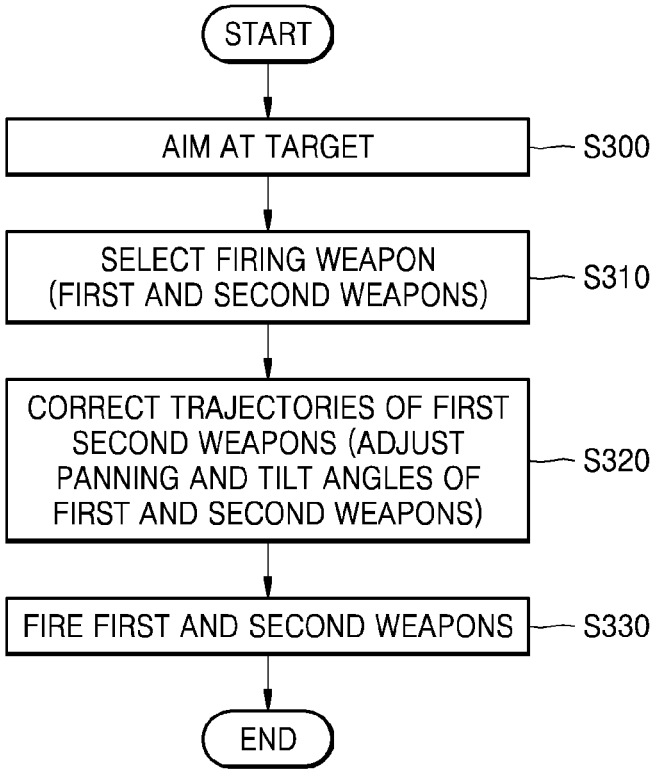
FIG. 9 is a flowchart of a method of controlling the weapon control system of FIGS. 1 and 2, according to an exemplary embodiment.

FIG. 9 is a flowchart of a method of controlling the weapon control system of FIGS. 1 and 2, according to another embodiment. In FIG. 9, the operations of the intense shooting mode performed by selecting both of the first and second weapons of the weapon control system as firing weapons are described.

In the intense shooting mode, after a mark (target) is aimed at by rotating the frame of the weapon control system (S300), both of the first and second weapons are selected as firing weapons (S310). Then, a trajectory of each of the first and second weapons selected as firing weapons is corrected by adjusting at least one of a panning angle and a tilt angle of each of the first and second weapons selected as the firing weapons (S320). In the correcting of the trajectories of the first and second weapons (S320), the trajectory of each of the first and second weapons is corrected to increase accuracy of firing in consideration of the position of a target and a trajectory range of the first weapon and the position of a target and a trajectory range of the second weapon.

After the correcting of the trajectories of the first and second weapons (S320), each of the first and second weapons is fired (S330). As such, when shooting is performed by both the first and second weapons, the goal of shooting may be surely achieved because firing power of the first and second weapons may be concentrated on a single target.

In the firing of each of the first and second weapons (S330), in order to reduce influence of vibration generated by the firing operation of each of the first weapon and the second weapon, shooting time points of the first weapon and the second weapon may be adjusted to be in sequence so that the shooting of the first weapon and the shooting of the second weapon may be sequentially performed.

For example, although the first weapon and the second weapon may be simultaneously fired, when the first weapon and the second weapon perform shooting at the same time, vibration generated by the firing of the first weapon may have a significant influence on the second weapon due to mechanical properties of the weapon control system. Accordingly, to reduce the influence of the vibration between the first weapon and the second weapon, the first weapon is primarily operated to perform shooting and, when the vibration due to the firing of the first weapon stops after the shooting of the first weapon ends, the second weapon may be operated to perform shooting.

Figure 10:
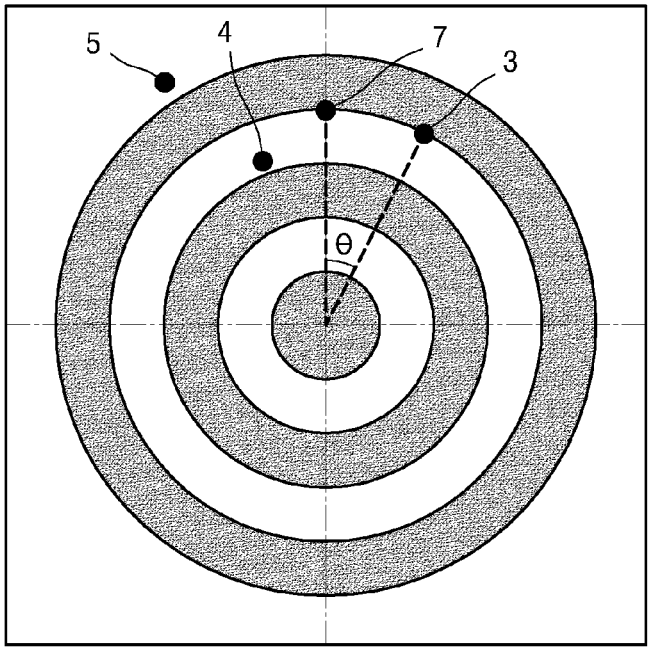
FIG. 10 illustrates an example in which a plurality of targets are indicated on a display, according to an exemplary embodiment.
Figure 11:
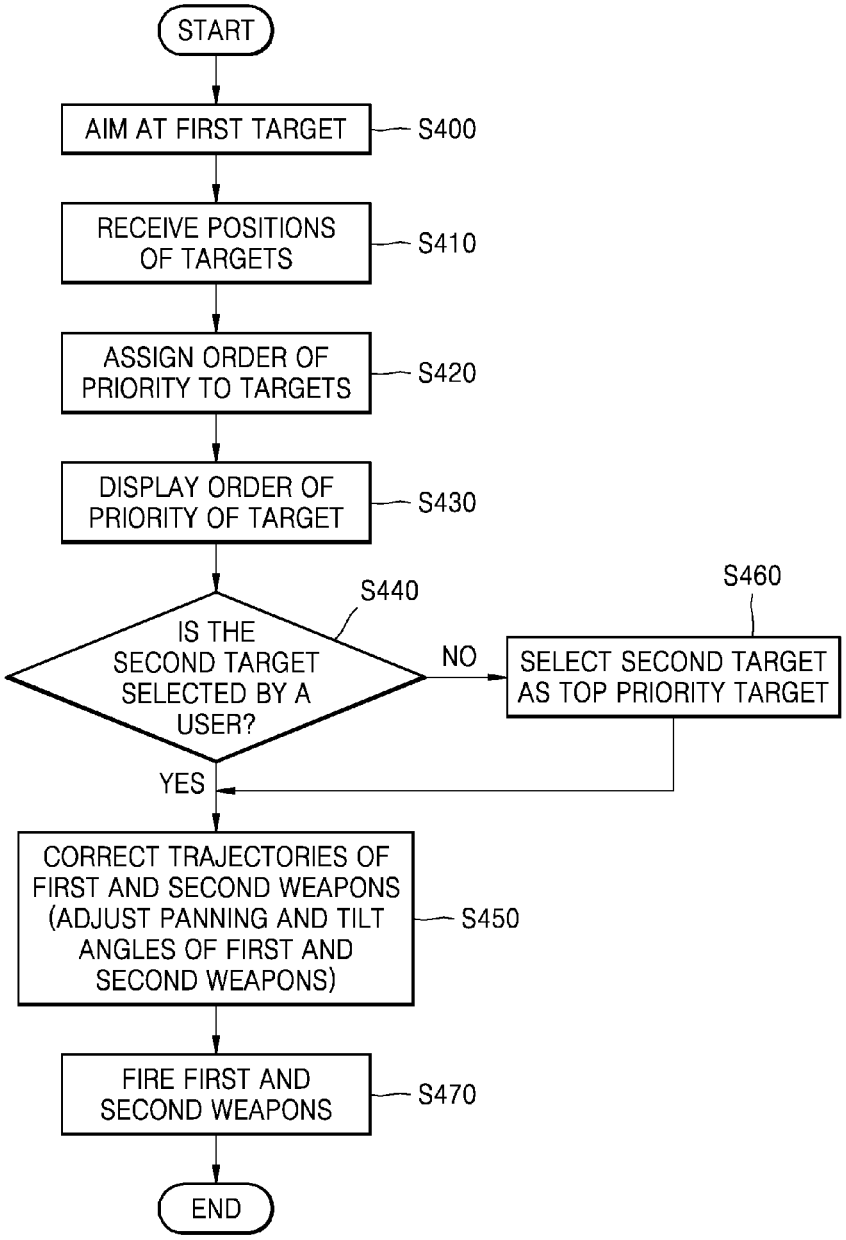
FIG. 11 is a flowchart of a method of controlling the weapon control system of FIGS. 1 and 2, according to an exemplary embodiment.
Figure 12:
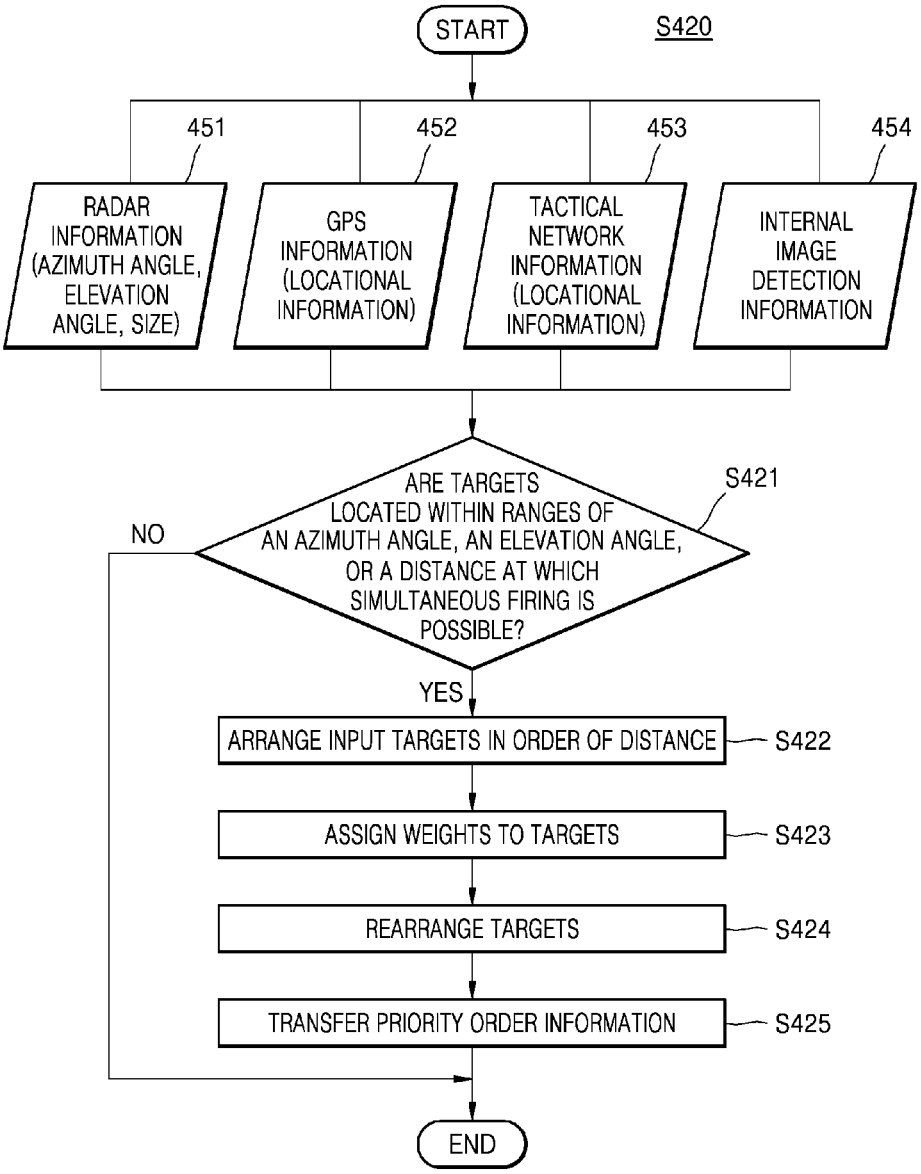
FIG. 12 is a flowchart of an operation of assigning the order of priority to a plurality of targets in the control method of FIG. 11, according to an exemplary embodiment.

FIG. 10 illustrates an example in which a plurality of targets are indicated on a display. FIG. 11 is a flowchart of a method of controlling the weapon control system of FIGS. 1 and 2, according to another embodiment. FIG. 12 is a flowchart of an operation of assigning the order of priority to a plurality of targets in the control method of FIG. 11. In FIGS. 10 to 12, an operation in which shooting on a plurality of targets located at different positions is performed by using the weapon control system is illustrated.

Referring to FIG. 11, in an aiming operation (S400), the weapon control system is aimed at the first target, which is a target intended to be shot at, by a signal of the operating computer that transmits a command to the weapon control system or as a user manipulates the weapon control system. The aiming operation (S400) may be performed together with or after a first target selection operation in which the first target to be aimed at is selected. The first target selection operation may be performed, for example, manually by a user or automatically by the weapon control system.

A firing weapon selection operation in which a firing weapon is selected may be performed before the aiming operation (S400), simultaneously with the aiming operation (S400), or after the aiming operation (S400). The firing weapon selection operation may include selecting one of the first weapon and the second weapon as a first firing weapon to fire at a first target and selecting the other one of the first weapon and the second weapon as a second firing weapon to fire at a second target.

Although in the above description the first weapon is selected as the first firing weapon and the second weapon is selected as the second firing weapon, the present disclosure is not limited thereto, and the second weapon may be selected as the first firing weapon and the first weapon may be selected as the second firing weapon. The selection of the first firing weapon and the second firing weapon may be automatically performed by the weapon control system or manually performed by the user.

After or simultaneous with the aiming operation (S400), an information receiving operation (S410) in which the weapon control system receives target information related to the position of a target from at least one of a detection apparatus, a tactical network, an artificial satellite, a radar, and an imaging apparatus of the weapon control system is performed.

After the information receiving operation S410, a priority order assigning operation (S420) is performed in which the operating computer assigns the order of priority to each of a plurality of targets based on the target information.

FIG. 12 illustrates detailed operations included in the priority order assigning operation (S420) in which the order of priority is assigned to the targets of FIG. 11. In the priority order assigning operation (S420), the order of priority is assigned to the targets, except for the first target on which the firing weapon is to fire, among the detected targets. The order of priority assigned to the targets may correspond to the order or priority related to a second target at which the second weapon is firing.

Referring to FIG. 12, the priority order assigning operation (S420) may include a firing range determination operation (S421) in which it is determined whether detected targets are located within ranges of an azimuth angle, an elevation angle, and a distance so that simultaneous firing by the first weapon and the second weapon is possible. This may be done by comparing and analyzing radar information 451 including information about an azimuth angle, an elevation angle, and a size of each of the targets; GPS information 452 including locational information related to a current location of each of the targets or the weapon control system; tactical network information 453 (tactical command information such as locational information of targets, a command setting a target subject to top priority firing, or tactical command information such as a shooting time point or a shooting method received from a tactical network connected to the operating computer; and internal image detection information 454 including information about the sizes or distances of the targets that the weapon control system internally detects from image information obtained by the imaging apparatus of the weapon control system.

The firing range determination operation (S421) may be performed independent of the priority order assigning operation (S420). In other words, the priority order assigning operation (S420) may be performed or may not be performed based on a result of the firing range determination operation (S421).

When no target on which simultaneous firing by the first weapon and the second weapon is possible is determined to be present in the firing range determination operation (S421), the targets are not assigned with an order of priority and the process ends. However, when there are targets on which simultaneous firing by the first weapon and the second weapon is possible, an arrangement operation (S422) in which input targets are arranged in an order of a distance, a weight assigning operation (S423) in which weights are assigned to the targets, a rearrangement operation (S424) in which the targets are rearranged based on the assigned weights, and an information transfer operation (S425) in which information about the order of priority of the targets is generated and transferred, are performed.

As an example of the weight addition operation (S423), weights may be assigned to targets subject to the top priority firing by combining tactical command information and information about distances of the targets received from the tactical network.

As another example of the weight addition operation (S423), a high weight may be assigned to a target located in a range in which trajectory ranges of the first weapon and the second weapon do not overlap with each other when the first weapon and the second weapon simultaneously perform firing, considering the trajectory ranges of the first weapon and the second weapon.

As another example of the weight addition operation (S423), weights may be assigned to targets in an order of a high hit rate of firing considering the size or distribution of the targets.

As another example of the weight addition operation (S423), when the tactical network information (453) includes a command to assign the top priority order of a target, the target having the top priority order may be assigned the highest weight.

Referring to FIG. 11, after the priority order assigning operation (S420), a display operation (S430) is performed in which information about the order of priority and the positions of a plurality of targets 3, 4, 5, and 7, detected by using the information about the positions of the targets, is displayed on the display as illustrated in FIG. 10.

Referring to FIG. 10, the detected targets 3, 4, and 5 are displayed on the display, with a first target 7 being a target upon which the first weapon performs firing. The targets 7, 3, 4, and 5 may be indicated by small circles on the display, and information about the priority order of the targets 7, 3, 4, and 5 may be displayed on the display with the small circles indicating the positions of the targets 7, 3, 4, and 5.

The information about the priority order of the targets 7, 3, 4, and 5 may be indicated by, for example, images or signs such as numbers, characters, or arrows. The information about the priority order of the targets 7, 3, 4, and 5 may be indicated by changing the color of the small circles indicating the positions of the targets 7, 3, 4, and 5, or by changing the thickness or type of line.

In FIG. 10, the targets 3 and 4, located within an angular range of "θ" to the left and right in the horizontal direction with respect to the first weapon aligned to the first target 7, are each indicated as a target, that is, a second target candidate, subject to firing by the second weapon that is designated as the second firing weapon.

For example, the second weapon is set to rotate with a panning angle of up to 21° to the left and right from the center. However, since the maximum launch angle of the second weapon in the horizontal direction is 3°, the angular range in the horizontal direction to set the targets 3 and 4 subject to firing by the second weapon is set to be 18°, considering the maximum launch angle of the second weapon in the horizontal direction.

Referring to FIG. 11, a second target selection operation in which a second target is selected may include an input receiving operation (S440) and an automatic selection operation (S460).

In the input receiving operation (S440), a user's input operation to select a second target may be received. For example, when the user selects the target 3 located to the right of the first target 7 in FIG. 10 as the second target, the operating computer selects the second weapon as a second firing weapon that performs firing at the target 3 selected as the second target.

When no user input operation for selecting the second target is received, an automatic selection operation (S460) may be performed in which a target having the top priority order among the targets 3, 4, and 5 assigned with the order of priorities is selected as the second target.

After the second target is set, a trajectory correction operation (S450) is performed in which a trajectory direction of the first weapon is corrected by adjusting the panning angle and the tilt angle of the first weapon to have the first weapon aligned to the first target 7, and a trajectory direction of the second weapon is corrected by adjusting the panning angle and the tilt angle of the second weapon to have the second weapon aligned to the second target 3.

After the trajectory correction operation (S450), a firing operation (S470) is performed in which firing is performed with the first and second weapons. In the firing operation (S470), the first and second weapons may simultaneously perform firing, or the first and second weapons may sequentially perform firing with a time interval between the respective firings considering the interference on the trajectory range between the first and second weapons or a negative influence of vibration between the first and second weapons.

According to the above-described weapon control system configured as above, shooting may be performed by selecting any one of the first and second weapons or by simultaneously selecting both of the first and second weapons. Furthermore, when shooting is performed by simultaneously using both of the first and second weapons, targets subject to firing may be freely selected and, since influence due to the interference or vibration between the first and second weapons may be reduced, the weapon control system may be easily used, and effectiveness and accuracy of shooting may be improved simultaneously.

As described above, in the weapon control systems according to the above-described exemplary embodiments, shooting may be performed by selecting any one of the first and second weapons or by simultaneously using the first and second weapons having different trajectory ranges or the same trajectory range.

Furthermore, since a panning angle and a tilt angle of each of the first and second weapons are independently controlled and adjustment ranges of the panning angles of the first and second weapons do not interfere with each other, targets subject to firing may be freely selected when shooting is performed by using the first and second weapons simultaneously.

In addition, since information about the order of priority of targets that may be selected is provided by analyzing detected targets, effective and accurate shooting may be performed even when the weapon control system is remotely controlled.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A weapon control system comprising:

a base;

a frame rotatably coupled to the base and rotatable about a first rotation axis;

a first actuator rotating the frame with respect to the base;

a first weapon rotatably coupled to the frame and rotatable about a second rotation axis in a direction crossing the first rotation axis;

a second actuator rotating the first weapon with respect to the frame;

a rotating support rotatably coupled to the frame and rotatable about a third rotation axis in a direction crossing the first rotation axis;

a third actuator rotating the rotating support with respect to the frame;

a second weapon rotatably coupled to the rotating support and rotatable about a fourth rotation axis in a direction crossing the third rotation axis;

a fourth actuator rotating the second weapon with respect to the rotating support; and an actuator controller controlling the first actuator, the second actuator, the third actuator, and the fourth actuator.

2. The weapon control system of claim 1, wherein the second rotation axis and the third rotation axis are parallel with each other.

3. The weapon control system of claim 2, wherein the third rotation axis is spaced apart from the second rotation axis in an upward direction away from the base.

4. The weapon control system of claim 1, wherein the first rotation axis and the fourth rotation axis are spaced apart from each other and are parallel with each other.

5. The weapon control system of claim 1, wherein the first rotation axis and the fourth rotation axis coincide.

6. The weapon control system of claim 1, further comprising:

an imaging apparatus rotatably coupled to the frame and rotatable about a fifth rotation axis in a direction crossing the first rotation axis; and a fifth actuator rotating the imaging apparatus with respect to the frame.

7. The weapon control system of claim 6, wherein the fifth rotation axis is spaced apart from the second rotation axis in a downward direction toward the base.

8. The weapon control system of claim 1, further comprising a firing controller that controls firing of the first weapon and firing of the second weapon.

9. The weapon control system of claim 8, further comprising an operating computer electrically connected to the actuator controller and the firing controller and providing an angle adjustment signal to adjust a panning angle and a tilt angle of each of the first weapon and the second weapon and a firing control signal for firing of each of the first weapon and the second weapon.

10. The weapon control system of claim 9, wherein the operating computer receives target information relative to a target from at least one of a detection apparatus detecting the target, a tactical network, an artificial satellite, a radar, and an imaging apparatus of the weapon control system, and the operating computer generates the angle adjustment signal and the firing control signal based on the target information.

11. The weapon control system of claim 10, wherein the operating computer performs one of a single shooting mode in which shooting is performed by selecting one of the first weapon and the second weapon as a firing weapon, and an intense shooting mode in which shooting is performed by selecting both of the first weapon and the second weapon as firing weapons, and in the single shooting mode, after a trajectory direction of the firing weapon is corrected to be aligned to the target, a direction of the other of the first weapon and the second weapon, not selected as the firing weapon, is adjusted to reduce mechanical interference in a shooting range of the firing weapon.

12. The weapon control system of claim 11, wherein, in the intense shooting mode, trajectory directions of the first weapon and the second weapon are all corrected to be aligned to the target, and during shooting, shooting time points of the first weapon and the second weapon are adjusted to be in sequence so that influence of vibrations due to shooting of the first weapon and the second weapon is reduced.

13. The weapon control system of claim 10, further comprising a display connected to the operating computer and displaying an image, wherein the target information of the operating computer comprises information about a plurality of targets, and the operating computer assigns one of the first weapon and the second weapon to a first target, assigns order of priority to the plurality of targets, except for the first target, and displays the plurality of targets and information about the order of priority.

14. The weapon control system of claim 13, further comprising a user input device that receives a user input and transfers a signal to the operating computer, wherein, when one of the plurality of targets, except for the first target, is selected as a second target through the user input device, the operating computer assigns the other of the first weapon and the second weapon not assigned to the first target, to the second target, and adjusts trajectory directions of the first weapon and the second weapon.

15. The weapon control system of claim 14, wherein, when no signal to select one of the plurality of targets is input through the user input device, the operating computer selects one target of the plurality of targets having a top priority order, except for the first target, as the second target, assigns the other of the first weapon and the second weapon not assigned to the first target, to the second target, and adjusts trajectory directions of the first weapon and the second weapon.

* * * * *